US010107150B2

(12) United States Patent
Weber

(10) Patent No.: US 10,107,150 B2
(45) Date of Patent: Oct. 23, 2018

(54) OIL CHANNELS, PRODUCED WITHOUT CUTTING AND PROVIDED IN A SPLIT ROTOR FOR A HYDRAULIC CAMSHAFT ADJUSTER

(71) Applicant: Schaeffler Technologies AG & Co. KG, Herzogenaurach (DE)

(72) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 160 days.

(21) Appl. No.: 15/101,610

(22) PCT Filed: Oct. 22, 2014

(86) PCT No.: PCT/DE2014/200585

§ 371 (c)(1),
(2) Date: Jun. 3, 2016

(87) PCT Pub. No.: WO2015/090298

PCT Pub. Date: Jun. 25, 2015

(65) Prior Publication Data

US 2016/0305291 A1 Oct. 20, 2016

(30) Foreign Application Priority Data

Dec. 18, 2013 (DE) ..... 10 2013 226 449

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2103/00* (2013.01)

(58) Field of Classification Search
CPC ..... F01L 1/3442; F01L 2001/34423; F01L 2103/00
See application file for complete search history.

(56) References Cited

U.S. PATENT DOCUMENTS

| | | | | |
|---|---|---|---|---|
| 7,497,193 | B2 * | 3/2009 | Knecht | F01L 1/3442 123/90.15 |
| 7,640,902 | B2 | 1/2010 | Knecht et al. | |
| 8,490,589 | B2 | 7/2013 | Arnold | |
| 8,550,046 | B2 | 10/2013 | Terfloth et al. | |
| 8,578,899 | B2 | 11/2013 | Ottersbach et al. | |
| 9,032,924 | B2 | 5/2015 | Busse | |
| 9,284,862 | B2 | 3/2016 | Frey | |

(Continued)

FOREIGN PATENT DOCUMENTS

| | | |
|---|---|---|
| DE | 102005026553 | 9/2006 |
| DE | 102008028640 A1 | 12/2009 |
| DE | 102008057492 | 5/2010 |

(Continued)

*Primary Examiner* — Zelalem Eshete
(74) *Attorney, Agent, or Firm* — Davidson, Davidson & Kappel, LLC

(57) ABSTRACT

A multipart rotor (1) for a hydraulic camshaft adjuster (2) is provided, the multipart rotor having a rotor main body (3) which, together with a first rotor secondary body (4), forms hydraulic means-conducting channels (9) oriented in a radial direction, the first rotor secondary body (4) being arranged radially within the rotor main body (3).

17 Claims, 7 Drawing Sheets

(56) References Cited

U.S. PATENT DOCUMENTS

| | | | |
|---|---|---|---|
| 2011/0126785 | A1 | 6/2011 | Terflotti et al. |
| 2015/0068484 | A1 | 3/2015 | Boese et al. |

FOREIGN PATENT DOCUMENTS

| | | | |
|---|---|---|---|
| DE | 102009031934 | A1 | 1/2011 |
| DE | 102009053600 | | 5/2011 |
| DE | 102011079183 | | 1/2013 |
| DE | 102011117856 | A1 | 5/2013 |
| DE | 102012208495 | | 11/2013 |
| DE | 102012209532 | | 12/2013 |
| EP | 1731722 | A1 | 12/2006 |
| EP | 2428656 | | 3/2012 |
| WO | WO2009152987 | A1 | 12/2009 |
| WO | WO2010128976 | A1 | 11/2010 |
| WO | WO2013164272 | | 11/2013 |

* cited by examiner

OIL CHANNELS, PRODUCED WITHOUT CUTTING AND PROVIDED IN A SPLIT ROTOR FOR A HYDRAULIC CAMSHAFT ADJUSTER

The present invention relates to a multipart rotor for a hydraulic camshaft adjuster, which includes a rotor main body which, together with a first rotor secondary body, forms hydraulic medium-conducting channels oriented in the radial direction.

A multipart rotor is understood in particular to mean a two- or three-part rotor. However, the two or three individual parts always have oil-conducting functions. In particular, they are connected to at least one hydraulic medium-conducting channel.

The rotor main body may also be understood as a central body or cup-shaped body. The hydraulic medium-conducting channel could also be referred to as an oil channel when pressure oil/oil is used as the hydraulic medium, which is usually the case.

BACKGROUND

Multipart rotors for hydraulic camshaft adjusters of the vane cell type are already known from the prior art. Thus, for example, rotor halves are joined with pins and/or sintered. It is known to mount two plastic rotor parts on a steel support, and to additionally glue two rotor parts which are joined thereto. In addition, rotor parts may ensure a connection by nested geometries that are adapted to one another. Furthermore, it is possible to provide two rotor halves which seal off oil channels via sintered facets. It is also known to design the rotor as a composite system in which a rotor core in addition to a cover forms oil channels. The use of a form fit and a press fit in oil channels is likewise known in principle.

Thus, for example, DE 10 2009 031 934 A1 provides a camshaft adjuster which includes a stator and a rotor, situated in the stator, which includes vanes, each of which is situated in a chamber formed between the stator and the rotor, the vanes dividing their respective chamber into two subchambers, and pressure oil being suppliable to and dischargeable from each subchamber via oil channels, so that the pressure oil may exert a torque on the rotor. Due to this configuration, the rotor is rotatable and adjustable for the camshaft adjustment, the rotor being made of a metallic base structure which includes a plastic liner, axially adjacent thereto, in which at least one of the oil channels is formed.

A two-part rotor is also known from WO 2010/128976 A1 which includes a sleeve part that is concentric with respect to a main body which forms a vane, the hydraulic medium-conducting channels formed as oil channels being present in the sleeve part.

Another hydraulic camshaft adjuster is known from DE 10 2008 028 640 A1. The cited publication describes a hydraulic camshaft adjuster which includes a drivable outer body having at least one hydraulic chamber, and an inner body which is situated internally with respect to the outer body and fixedly connectable to a camshaft, and which includes at least one swivel vane which extends radially into the hydraulic chamber, thus dividing the hydraulic chamber into a first and a second working chamber. The inner body also includes at least one oil supply line and one oil discharge line which extend from a casing interior to a casing exterior of the inner body, up to one of the two working chambers. The inner body is made up of at least one first element and one second element, each of the two elements at mutually facing front sides having a geometry which, together with the respective other element, forms the oil supply line and the oil discharge line of the inner part.

A multipart joined rotor for hydraulic camshaft adjusters having joint sealing profiles is also known from DE 10 2011 117 856 A1. The described camshaft adjusting device for internal combustion engines and a method for manufacturing same relate to a stator wheel and a rotor wheel which cooperates with the stator wheel. The stator wheel is driven in rotation about a rotation axis, the rotor wheel being connectable to a camshaft of the internal combustion engine, and in addition the stator wheel including radially inwardly facing stator vanes, between which radially outwardly facing rotor vanes (which define the vane cells) situated on the rotor wheel extend, so that fluid chambers/working chambers A and B are formed between the stator vanes and the rotor vanes, and which may be acted on with a pressure fluid via fluid channels, the rotor wheel including a first partial body and a second partial body, a joining surface of the first partial body and a joining surface of the second partial body being joined together, and depressions being introduced into at least one of the two joining surfaces in order to form the fluid channels, at least at spaced intervals. To provide a camshaft adjusting device which includes a rotor wheel that is formed from two partial bodies which are joined together, in the cited publication it is provided that the fluid channels are sealed off, and that a defined contact of the brought-together joining surfaces is created.

A camshaft adjuster which operates according to the swivel motor principle, which means that it is able to move back and forth at a certain angle, generally includes a stator and a rotor, as also provided in EP 1 731 722 A1, for example. The rotor itself is provided as a composite system made up of at least two components. One of the components is a cover. The other component of the composite system may be referred to as a rotor core. The cover is placed on the rotor.

Another hydraulic camshaft adjuster is known from WO 2009/1252987 A1.

The rotor in DE 10 2009 053 600 A1 has also proven to be easy to manufacture and robust under load. The cited publication provides a rotor, in particular for a camshaft adjuster, which includes a rotor base body having a hub part with a central oil supply line. At least one vane which is radially situated in the hub part, and an oil channel which extends through the hub part on both sides of a vane and which is fluidically connected to the central oil supply line, is provided in the hub part. The manufacture of the rotor base body is greatly simplified by dividing the rotor base body along a parting line so that it is made up of two base body parts. Journals or pins are inserted for joining the two rotor halves together. The journals are provided at one of the two rotor halves, and engage with recesses in the other rotor half.

SUMMARY OF THE INVENTION

However, the previous approaches have disadvantages with regard to costs, for example due to the provision of connecting pins or the need for keeping adhesives on hand which are additionally or exclusively used. In addition, hazardous materials are frequently involved which should be avoided. Furthermore, the connection obtained is often not robust enough for the requirements of the customer. In addition, when longitudinal press fits, heretofore common at certain locations, are used, deformations occur which should be avoided. Also, there is always a risk of the rotor jamming in the stator. The previous approaches are also not sufficiently secured against leaks. Furthermore, cracks or other component damage may occur during operation which result(s) in failure of the hydraulic camshaft adjuster.

In addition, the problem frequently arises that the individual parts of the rotor diverge at high oil pressures in the joint, resulting in leaks.

An object of the present invention is to eliminate or at least minimize the disadvantages from the prior art, and to allow an alternative design of hydraulic medium-conducting channels, i.e., oil channels, in the split rotor, specifically, to be able to increase competitive advantages. A further aim is to keep the split rotor from diverging under any circumstances.

For a generic rotor, the present invention provides that the first rotor secondary body is radially situated within the rotor main body. Stated in another way, the first rotor secondary body adjoins or rests against the rotor main body, at least in sections, on at least three sides.

The interior rotor sleeve is caulked in the rotor shell. The support disk is pressed, for example longitudinally pressed, into the rotor sleeve.

The outer rotor shell is inwardly exposed, with oil channels adjacent to vanes/rotor vanes, for example four rotor vanes, at eight locations, more or fewer locations also being possible. The oil channels are then present to the left and the right of the rotor vanes. An exposed area utilized in this way may also be designed as an indentation, channel, or guide having a through hole near the end.

(Eight) exposed areas may be created, without cutting, by displacing powder columns in a sintering tool.

It is advantageous when the rotor main body has a shell-like design and forms a circumferential groove into which the first rotor secondary body, designed in the manner of a sleeve, is inserted.

It is advantageous when the first rotor secondary body is made of ceramic and/or metallic sintered material.

It is also advantageous when the first rotor secondary body includes one or multiple connecting channels which in each case connect a radially inner hydraulic medium-conducting pocket on the rotor main body to a working chamber inlet, with a specific hydraulic medium-conducting channel for hydraulic medium, such as oil, connected in between.

The connecting channels may be provided, without cutting, in particular by displacing powder columns in a sintering tool.

The separation and sealing of the hydraulic medium-conducting channels/oil channels in the rotor interior take place via the rotor sleeve which is caulked in the rotor shell, with the oil channels/connecting channels half open.

It is advantageous when the connecting channels end up open at a front side of the first rotor secondary body.

When sintered material is used, oil channels in the rotor main body, i.e., an outer shell of the rotor which is made up overall of multiple parts according to the onion skin principle, which are axially exposed in the sintering mold may be provided. The rotor is made up, among other components, of an outer rotor shell, an interior rotor sleeve (i.e., an insert), and a second rotor secondary body or a support disk (i.e., a support ring/bearing ring) for the camshaft, this support disk being optional.

The rotor parts may have different thicknesses or densities, or may be made of different materials.

The oil distribution from a channel B takes place through the half-open oil channels in the support disk/the second rotor secondary body.

When the first rotor secondary body is designed as an oil-conducting sleeve in such a way that oil is conducted in one of the connecting channels, predominantly or at least in sections, in the axial direction, a particularly compact rotor shape may be implemented.

For functionality, it is advantageous when the connecting channels extend at different lengths from one front face of the oil-conducting sleeve to the other.

One advantageous exemplary embodiment is also characterized in that the supply to the connecting channels is provided at different axial positions, and the discharge from the connecting channels is provided at a single specified axial height of the particular working chamber inlet connected there.

In particular, it is advantageous when all working chamber inlets are present in the same transverse plane, oriented perpendicularly with respect to the axial direction.

It has proven to be advantageous when the rotor main body is connected in an axially and/or rotatably fixed manner to the first rotor secondary body via one or multiple caulkings and/or one or multiple pins.

To be able to provide a long service life of the rotor in a cost-effective manner, it is advantageous when a second rotor secondary body, which may be designed as a support ring or bearing ring for a camshaft and which is advantageously made of a steel alloy, is concentrically and radially situated within the rotor main body and the first rotor secondary body.

One advantageous exemplary embodiment is also characterized in that two or all components of the group made up of the rotor main body, the first rotor secondary body, and the second rotor secondary body are made of different materials or have different densities, hardnesses, and/or porosities.

Lastly, it could also be stated that the present invention relates to oil channels which are assembled by combining different parts of a rotor with one another, in particular a sleeve being fitted into a shell which has vane-like radially outwardly protruding projections.

An alternative to a three-part rotor made of sintered metal is provided in this way. The present invention allows an alternative design of the split rotor, and oil channels which are produced in the rotor without cutting.

BRIEF DESCRIPTION OF THE DRAWINGS

The present invention is also explained in greater detail below with the aid of the drawings, which illustrate various exemplary embodiments and variants.

DETAILED DESCRIPTION

Figure 1:
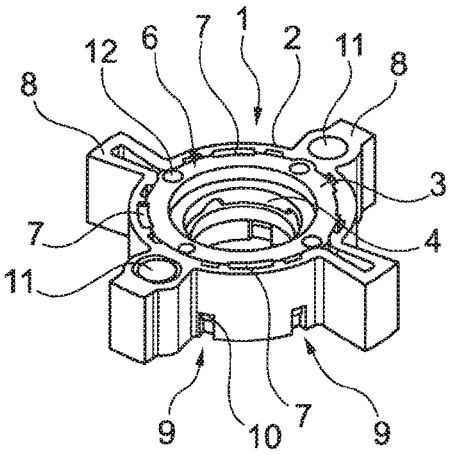
FIG. 1 shows a first rotor according to the present invention according to the onion skin principle, in a perspective (three-dimensional) view from the camshaft side.

The figures are merely schematic, and are used only for an understanding of the present invention. Identical elements are provided with the same reference numerals. Features of the individual exemplary embodiments may also be implemented in other exemplary embodiments, i.e., are interchangeable.

FIG. 1 illustrates a first specific embodiment of a multipart rotor 1. The rotor is provided for use in a hydraulic camshaft adjuster 2 as illustrated in FIGS. 20 through 23.

Rotor 1 includes a rotor main body 3, which may also be referred to as an outer rotor shell. In addition, rotor 1 includes a first rotor secondary body 4, which may be referred to as an interior rotor sleeve, and a second rotor secondary body 5, which may be referred to as a support ring. Rotor main body 3 and first rotor secondary body 4 are generally manufactured from sintered material, in particular metallic sintered material. Second rotor secondary body 5 is manufactured from steel.

First rotor secondary body 4 is inserted into a groove 6 in shell-like rotor main body 3, and rests against rotor main body 3, at least in sections, on three sides. This is particularly apparent in FIG. 2.

Rotor main body 3 and first rotor secondary body 4 are joined together by caulking 7 at positions which are spaced apart from one another in the circumferential direction.

Caulking is understood to mean a force-fit and form-fit connection resulting from plastic deformation. Rolling processes are one option. Rotor main body 3 includes four radially protruding vanes 8 on its outer side which may have grooves, not illustrated, for accommodating sealing elements.

Rotor main body 3 and first rotor secondary body 4 together define hydraulic medium-conducting channels/oil channels 9. Radially outer working chamber inlets 10 which allow working chambers A and B of a vane cell to be supplied with oil are apparent in FIG. 1.

The vane cell is present between rotor main body 3 and a stator, not illustrated, which surrounds same, and in particular is delimited by two vanes 8. A radially inwardly extending projection divides the vane cell into two working chambers, namely, working chambers A and B. Two vanes 8 have holes 11 for accommodating locking pins. Also present in first rotor secondary body 4 are fixing holes 12 into which pins, such as short pins or spring suspension pins, may be inserted in order to ensure fixing of rotor main body 3 to first rotor secondary body 4 in addition to or as an alternative to caulking(s) 7.

Figure 6:
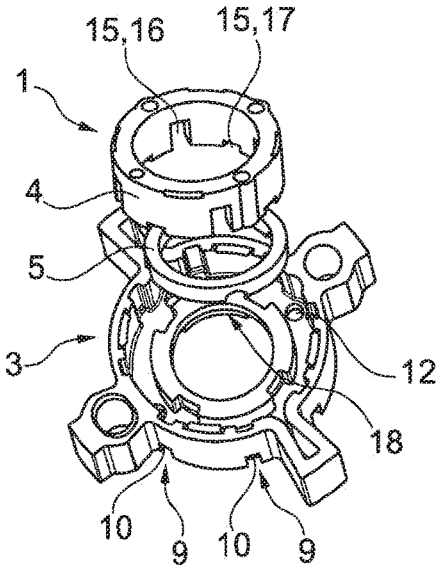
FIG. 6 shows an exploded view of the rotor from FIGS. 1 through 5 in a viewing direction from the camshaft side.
Figure 7:
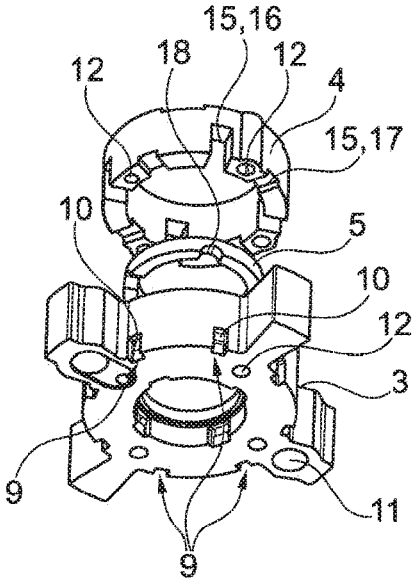
FIG. 7 shows an exploded view, comparable to that in FIG. 6, of the rotor from FIGS. 1 through 6, but from the front side of the rotor.

The pins in question also engage with fixing holes 12, designed as boreholes, in rotor main body 3. Reference is made here to FIGS. 6 and 7.

Returning to FIG. 1, it is pointed out that a smaller or larger number of vanes 8 may be present.

Figure 2:
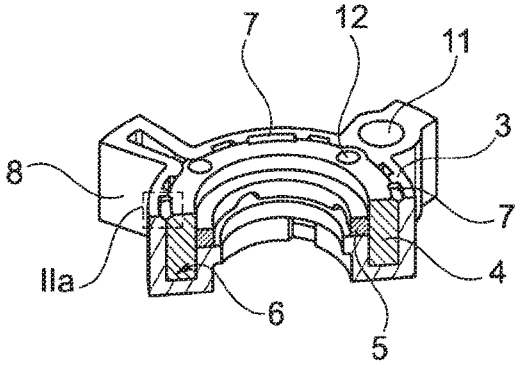
FIG. 2 shows a partial sectional view in a perspective illustration of the rotor from FIG. 1.
Figure 2A:
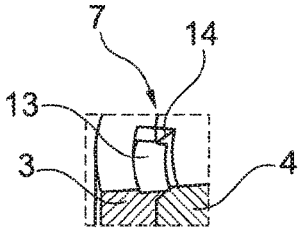
FIG. 2*a* shows detail IIa from FIG. 2.

The caulking will become clear in synopsis with FIGS. 2 and 2*a*, a tab/a projection 13 being forced into a pocket/a recess 14 by a reshaping procedure, resulting in a force-fit and form-fit connection. Such a connection may also be provided between second rotor secondary body 5 and first rotor secondary body 4 and/or rotor main body 3. Alternatively or additionally, however, it is possible to press second rotor secondary body 5 onto first rotor secondary body 4, in this case with the aid of a longitudinal press fit, for example, which is used only at this location.

Figure 3:
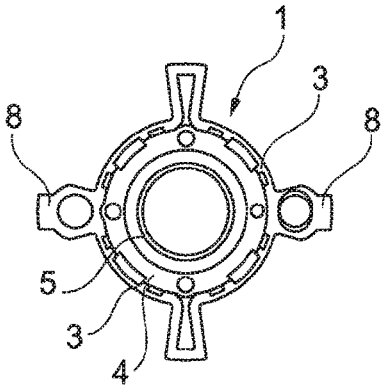
FIG. 3 shows a projection view of the rotor from FIGS. 1 and 2 from the camshaft side.
Figure 4:
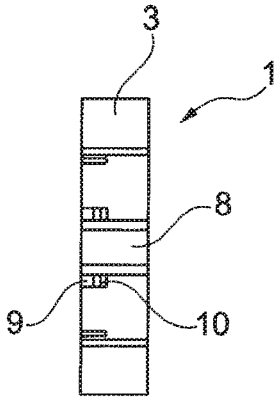
FIG. 4 shows the rotor from FIG. 3 in a view from the left (side view)
Figure 5:
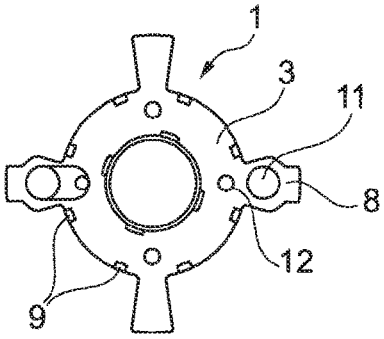
FIG. 5 shows a view of the rotor from FIGS. 1 through 4 from a front side facing away from the camshaft.

Working chamber inlets 10 are also clearly apparent in FIG. 4, and hydraulic medium-conducting channels 9 are clearly apparent in FIG. 5. FIG. 3 depicts the onion skin-like arrangement of rotor main body 3, first rotor secondary body 4 situated concentrically with respect to same, and second rotor secondary body 5 situated concentrically with respect to same, rotor main body 3 forming the outermost layer and at least partially enclosing first rotor secondary body 4.

First rotor secondary body 4 also includes connecting channels 15, as shown clearly in FIG. 6. There are two different types of connecting channels, namely, a high connecting channel 16 and a low connecting channel 17. High (long) connecting channel 16 is provided for supplying oil from a hydraulic medium channel/oil channel 9 which ensures that working chamber A is supplied. Lastly, low (short) connecting channel 17 supplies working chamber B.

Oil channel A may be used as oil channel B, and vice versa, with an appropriate design of the oil connection to the central valve.

To facilitate the introduction of the oil into connecting channels 15, support ring-like second rotor secondary body 5 has concave recesses 18. These recesses 18 are present only on a front side of second rotor secondary body 5. This is also clearly apparent in FIG. 7.

Figure 10:
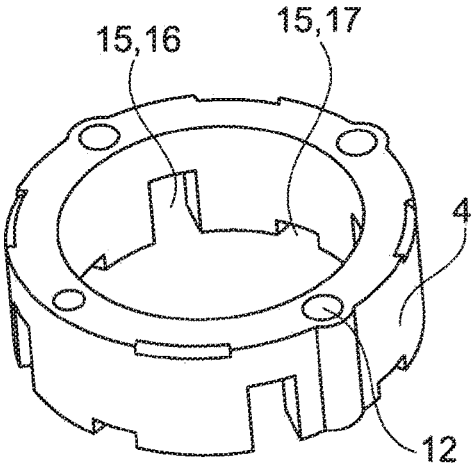
FIGS. 10 and 11 show perspective illustrations of the first rotor secondary body/the interior rotor sleeve, comparable to those in FIGS. 8 and 9.
Figure 11:
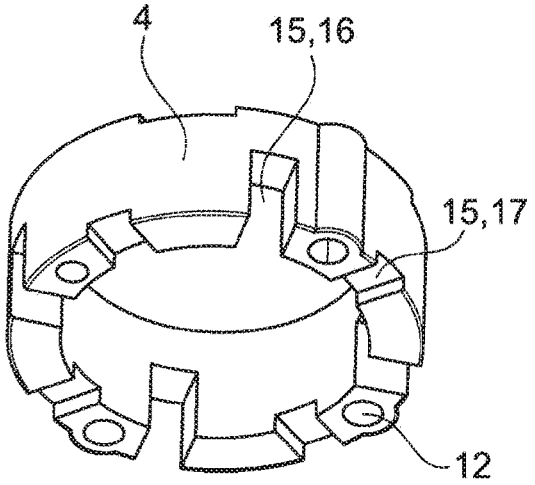

A fixing hole 12 is always present adjacent to a high connecting channel 16. Connecting channels 15 are not closed, i.e., are open, on a front side of second rotor secondary body 5, as clearly illustrated in FIGS. 10 and 11.

Figure 8:
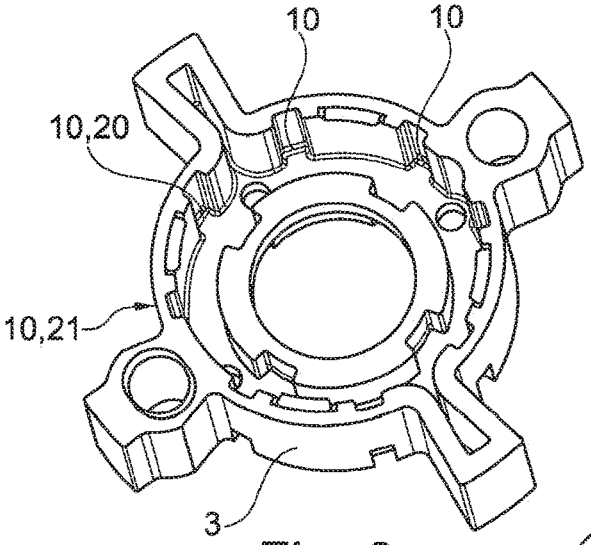
FIGS. 8 and 9 show perspective illustrations from the side of the camshaft and from the front side of the rotor main body/the outer rotor shell.
Figure 9:
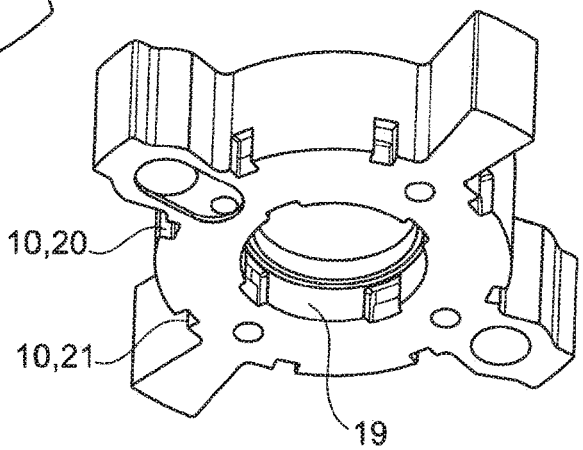

There are four inner recesses at radially inner wall 19 of rotor main body 3, as is apparent in FIG. 9. These four recesses are used as oil-conducting pockets. Likewise, four channel-like depressions are present on the radial outer side of wall 19. An outlet 20 leads to working chamber A. An outlet 21 is used for supplying working chamber B. This is clearly apparent in FIG. 8.

Figure 12:
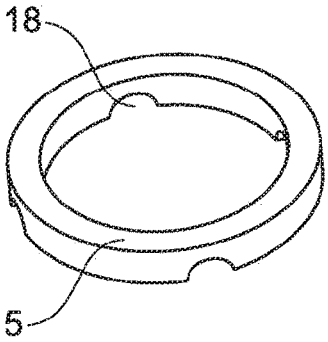
FIGS. 12 and 13 show a type of illustration, comparable to FIGS. 10 and 11, of the second body/support ring for a camshaft, close to the rotor.
Figure 13:
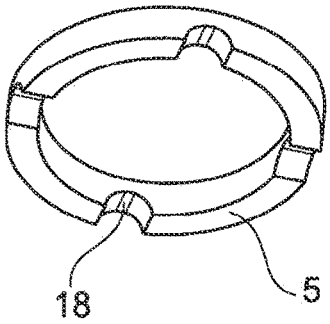
Figure 16:
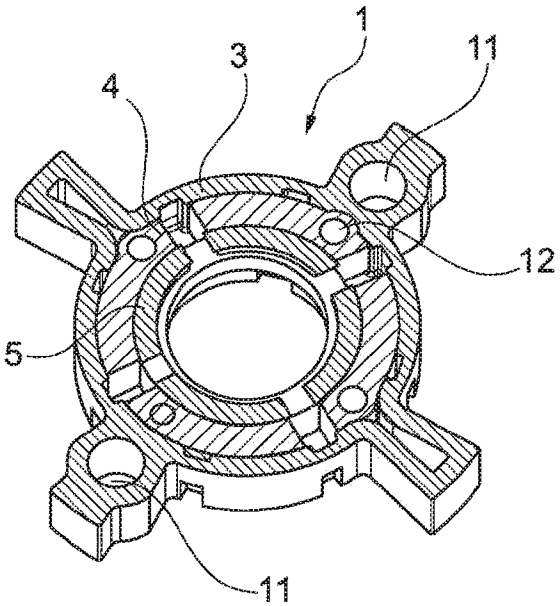
FIG. 16 shows a perspective illustration of the rotor from FIG. 15 in the section plane depicted in FIG. 14.
Figure 15:
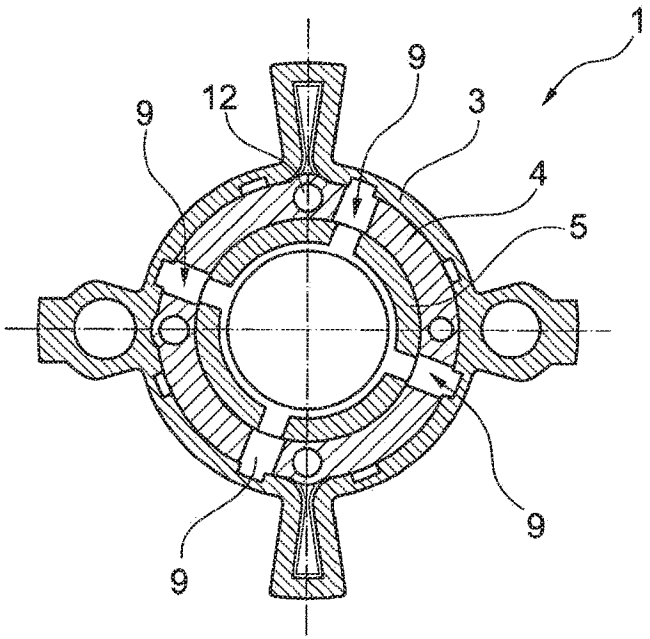
FIG. 15 shows a section through the rotor from FIG. 14 along line XV.
Figure 14:
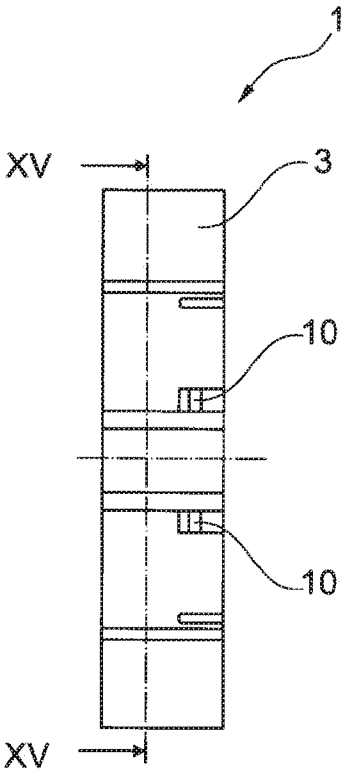
FIG. 14 shows a side view of the rotor from the preceding figures, with plotted section plane XV.
Figure 19:
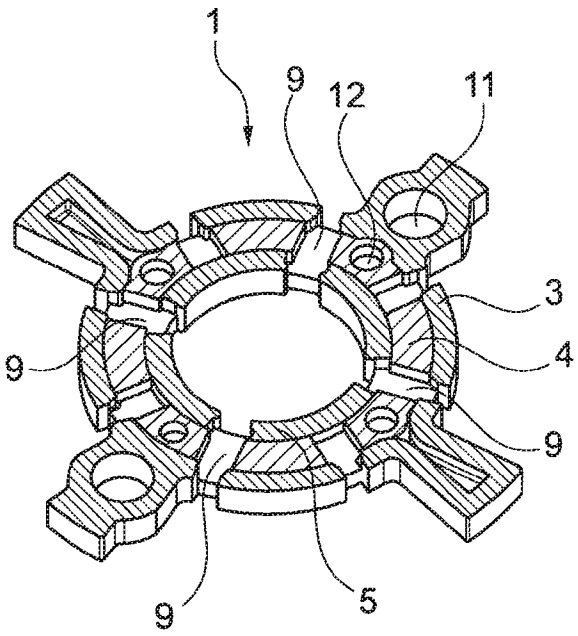
FIGS. 17 through 19 show an illustration sequence, comparable to FIGS. 14 through 16, whereby, unlike in FIGS. 14 through 16, the cross section is not through oil channels/hydraulic medium-conducting channels A, but, rather, through oil channels/hydraulic medium-conducting channels B, so that the illustration in FIG. 18 depicts a section along line XVIII from FIG. 17.
Figure 18:
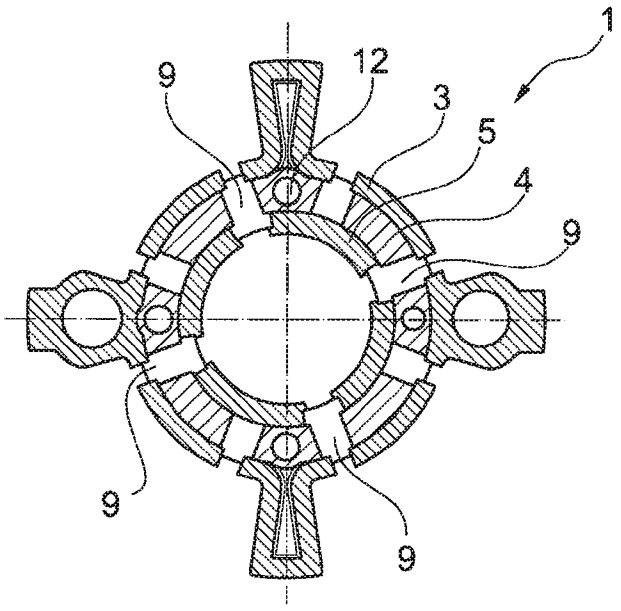
Figure 17:
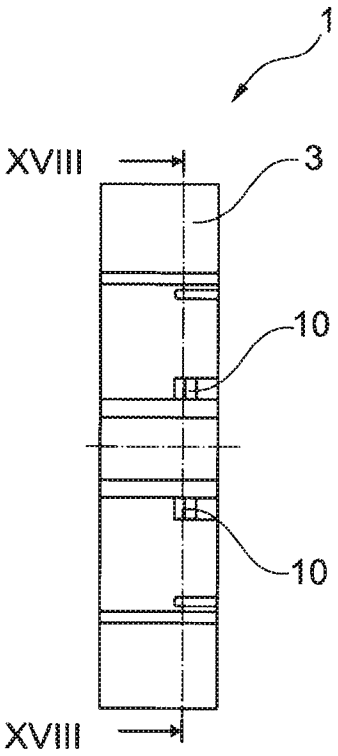
Figure 21:
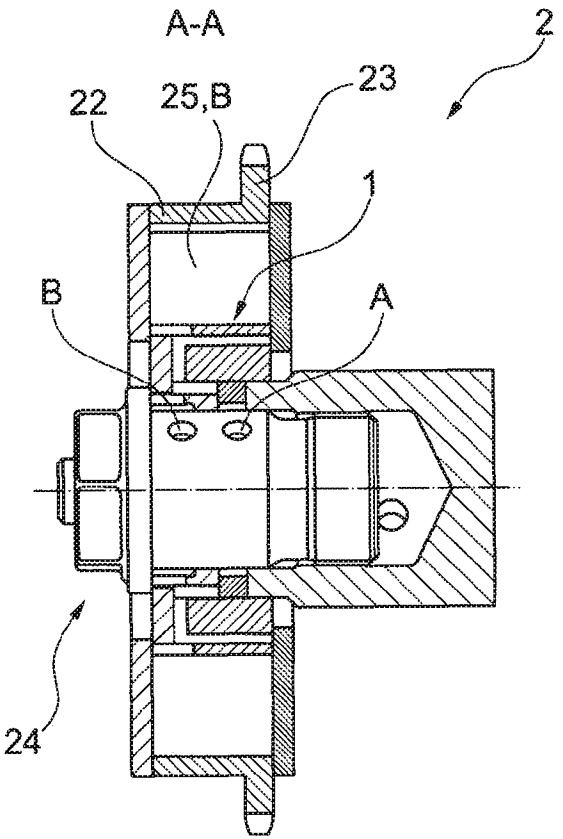
FIG. 21 shows a section through the camshaft adjuster in FIG. 20 along line XXI through oil channels/hydraulic medium-conducing channels B.
Figure 20:
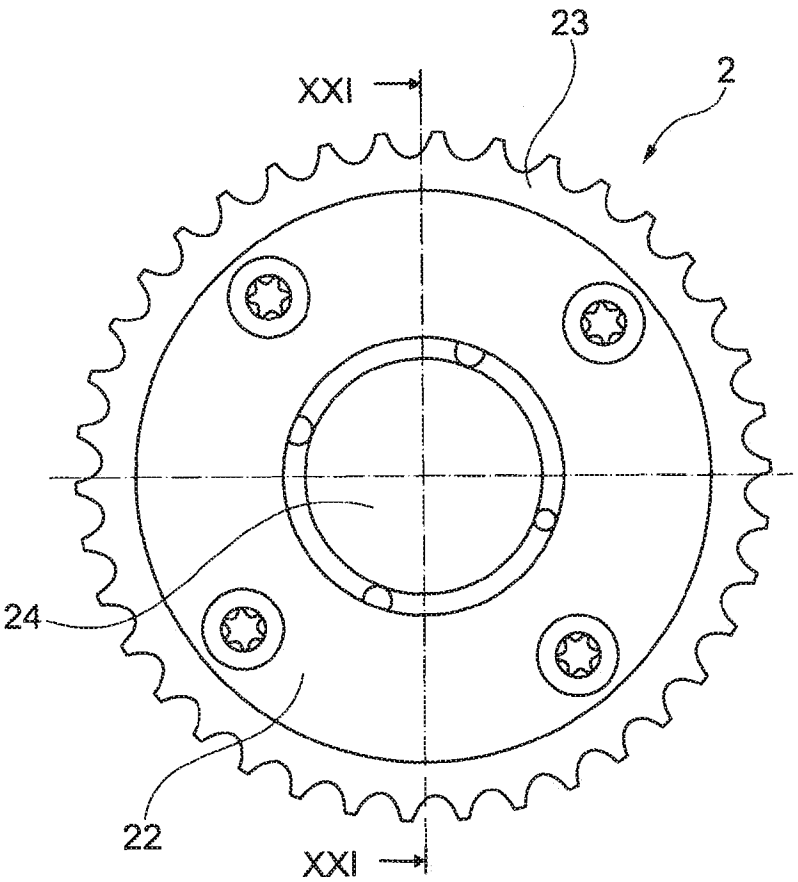
FIG. 20 shows a top view of an assembled hydraulic camshaft adjuster with an integrated rotor of the type according to the present invention.
Figure 23:
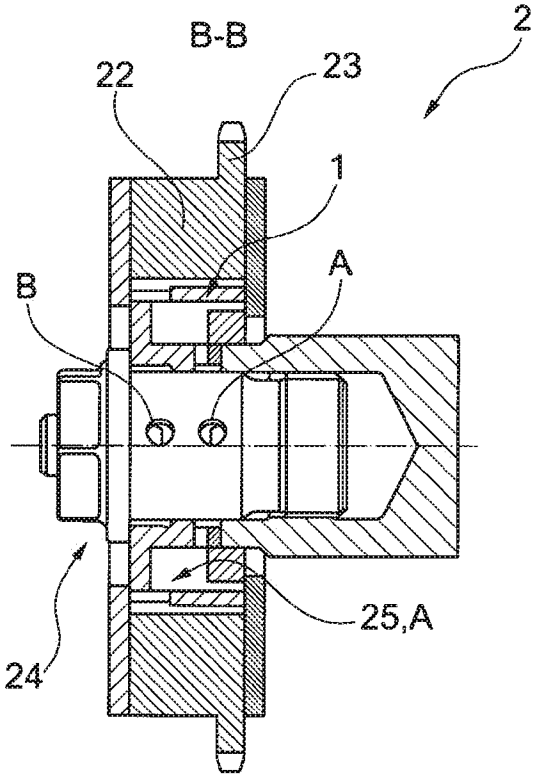
FIG. 23 shows a section along line XXIII through the camshaft adjuster and the rotor from FIG. 22 integrated therein, at the level of oil channels/hydraulic medium-conducting channels A.
Figure 22:
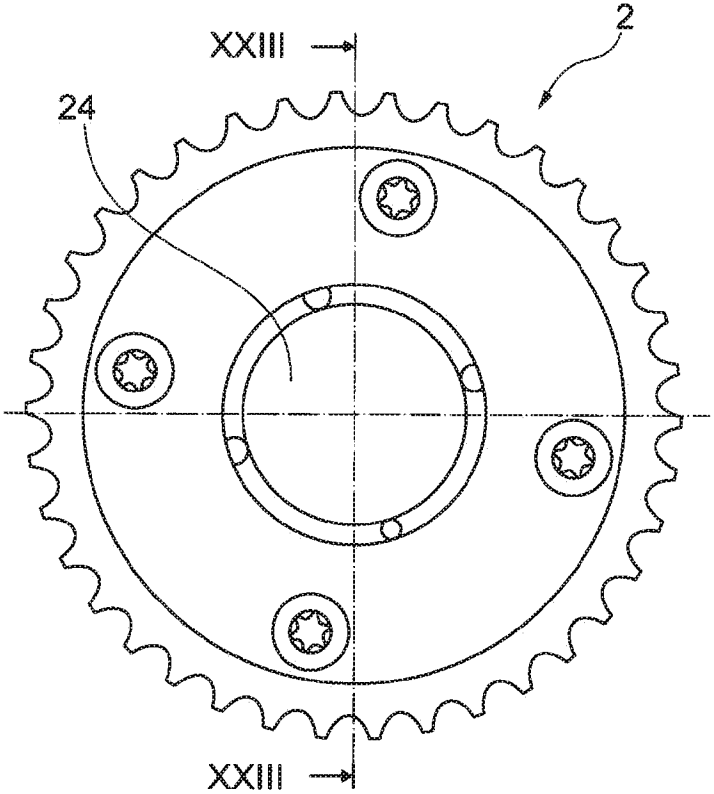
FIG. 22 shows a variant, rotated with respect to the illustration from FIG. 20, of the multipart rotor in the camshaft adjuster, in a top view.

The ring-like nature of second rotor secondary body 5, which may also be designed as a (perforated) disk, is clearly apparent in FIGS. 12 and 13.

The interplay of the individual components in order to ensure a supply of oil to working chambers A and B, even though the oil on the radial inner side of rotor 1 is supplied from different axial directions and is diverted at second rotor secondary body 5, is shown in synopsis with FIGS. 14 through 19. The individual openings which define hydraulic medium-conducting channels 9 are clearly apparent from FIGS. 15 and 18, and from FIGS. 16 and 19. The particular position of the section is apparent upon examination of FIGS. 14 and 17.

FIGS. 20 through 23 illustrate complete camshaft adjuster 2 with some of its essential components, and depict a stator 22 with a gearwheel (spur gear) 23 integrated thereon. A central valve 24 which acts as a central screw is inserted which passes through stator 22 and engages with rotor 1. Oil discharge openings therein supply working chambers A and B of vane cell 25 when appropriate channels 9 and 15, described above, are connected in between.

When pins are utilized, short pins or long pins may be employed, the short pins having a shorter axial extension than rotor 1, and the long pins having a longer axial extension than rotor 1, and the long pins being utilized as spring suspension pins.

LIST OF REFERENCE NUMERALS

1 rotor
2 camshaft adjuster
3 rotor main body
4 first rotor secondary body
5 second rotor secondary body
6 groove
7 caulking
8 vane
9 hydraulic medium-conducting channel
10 working chamber inlets
11 hole/borehole
12 fixing hole/borehole
13 tab/projection
14 pocket/recess
15 connecting channel
16 high connecting channel
17 low connecting channel
18 recess in the second rotor secondary body
19 wall of the rotor main body
20 outlet for working chamber A
21 outlet for working chamber B
22 stator
23 gearwheel
24 central valve
25 vane cell

What is claimed is:

1. A multipart rotor for a hydraulic camshaft adjuster, the rotor comprising:

a rotor main body, together with a first rotor secondary body, forming hydraulic medium-conducting channels oriented in the radial direction, the first rotor secondary body being situated radially within the rotor main body, the rotor main body extending further radially inward than the first rotor secondary body.

2. The rotor as recited in claim 1 wherein the rotor main body has a shell design and forms a circumferential groove into which the first rotor secondary body, having a sleeve design, is inserted.

3. The rotor as recited in claim 1 wherein the first rotor secondary body is made of sintered material.

4. The rotor as recited in claim 1 wherein the first rotor secondary body includes connecting channels, the connecting channels in each case connecting a radially inner hydraulic medium-conducting pocket on the rotor main body to a working chamber inlet, with a specific hydraulic medium-conducting channel for hydraulic medium connected in between.

5. The rotor as recited in claim 4 wherein the first rotor secondary body is designed as an oil-conducting sleeve in such a way that oil is conducted in one of the connecting channels, predominantly or at least in sections, in the axial direction.

6. The rotor as recited in claim 5 wherein the connecting channels extend at different lengths from one front face of the oil-conducting sleeve to the other.

7. The rotor as recited in claim 4 wherein a supply to the connecting channels is provided at different axial positions, but the discharge is provided at an axial height of the particular working chamber inlet connected there.

8. The rotor as recited in claim 4 wherein all working chamber inlets are present in the same transverse plane, oriented perpendicularly with respect to the axial direction, and are produced without cutting.

9. The rotor as recited in claim 1 wherein the rotor main body is connected in an axially or rotatably fixed manner to the first rotor secondary body via at least one caulking or at least one pin.

10. The rotor as recited in claim 1 further comprising a second rotor secondary body is concentrically and radially situated within the rotor main body and the first rotor secondary body.

11. The rotor as recited in claim 1 wherein the second rotor secondary body is a support ring or bearing ring for a camshaft.

12. A multipart rotor for a hydraulic camshaft adjuster, the rotor comprising:

a rotor main body, together with a first rotor secondary body, forming hydraulic medium-conducting channels oriented in the radial direction, the first rotor secondary body being situated radially within the rotor main body, wherein the first rotor secondary body includes connecting channels, the connecting channels in each case connecting a radially inner hydraulic medium-conducting pocket on the rotor main body to a working chamber inlet, with a specific hydraulic medium-conducting channel for hydraulic medium connected in between.

13. The rotor as recited in claim 12 wherein the first rotor secondary body is designed as an oil-conducting sleeve in such a way that oil is conducted in one of the connecting channels, predominantly or at least in sections, in the axial direction.

14. The rotor as recited in claim 13 wherein the connecting channels extend at different lengths from one front face of the oil-conducting sleeve to the other.

15. The rotor as recited in claim 12 wherein a supply to the connecting channels is provided at different axial positions, but the discharge is provided at an axial height of the particular working chamber inlet connected there.

16. The rotor as recited in claim 12 wherein all working chamber inlets are present in the same transverse plane, oriented perpendicularly with respect to the axial direction, and are produced without cutting.

17. A multipart rotor for a hydraulic camshaft adjuster, the rotor comprising:

a rotor main body, together with a first rotor secondary body, forming hydraulic medium-conducting channels oriented in the radial direction, the first rotor secondary body being situated radially within the rotor main body, the first rotor secondary body resting against the rotor main body, at least in sections, on three sides.

* * * * *